United States Patent [19]

Mori et al.

[11] Patent Number: 4,490,768

[45] Date of Patent: Dec. 25, 1984

[54] APPARATUS FOR PREVENTING ARC DISCHARGE OF TRANSFER SWITCH CIRCUIT FOR INDUCTIVE LOAD

[75] Inventors: Toshihiro Mori; Yoshifumi Imai, both of Sagamihara; Masanori Matsui, Kawaski; Masao Masumura, Hachiouji, all of Japan

[73] Assignee: Jeco Co., Ltd., Kawasaki, Japan

[21] Appl. No.: 460,092

[22] Filed: Jan. 21, 1983

Related U.S. Application Data

[63] Continuation of Ser. No. 21,132, Mar. 16, 1979, abandoned.

[51] Int. Cl.[3] ..... H01H 3/42

[52] U.S. Cl. ..... 361/2; 361/10; 200/38 B

[58] Field of Search ..... 361/2, 3, 8, 9, 10, 361/11, 12; 200/153 LB, 38 B

[56] References Cited

U.S. PATENT DOCUMENTS

| | | | |
|---|---|---|---|
| Re. 29,158 | 3/1977 | Cartier | 200/38 B |
| 808,958 | 1/1906 | Varley | 200/153 LB |
| 1,941,377 | 12/1933 | Woodworth | 200/153 LB |
| 2,307,204 | 1/1943 | Ehrlich | 200/153 LB |
| 2,332,123 | 10/1943 | Whitted | 200/30 R |
| 2,469,341 | 5/1949 | Pearson | 200/38 BA |
| 2,939,337 | 6/1960 | Sweger | 200/153 LB |
| 3,694,723 | 9/1972 | Schneider et al. | 200/153 LB |
| 3,752,944 | 8/1973 | Cartier | 200/38 B |
| 3,858,017 | 12/1974 | Bertozzi et al. | 200/153 LB |
| 4,173,029 | 10/1979 | Rabindran | 361/3 |
| 4,413,164 | 11/1983 | Obermann | 200/38 B |

FOREIGN PATENT DOCUMENTS

| | | | |
|---|---|---|---|
| 258185 | 4/1965 | Australia | 200/38 |

*Primary Examiner*—Thomas W. Brown
*Assistant Examiner*—L. C. Schroeder
*Attorney, Agent, or Firm*—Townsend and Townsend

[57] ABSTRACT

In an arc preventing apparatus of a transfer switch connected to an inductive load, the movable contact of the transfer switch is stopped temporarily while it is transferred from one stationary contact to the other by means of a rotary cam. The cam is provided with a high point, a low point and a peripheral portion intermediate the high and low points so that while the actuating lever of the movable contact is engaging the intermediate peripheral portion, the movable contact is held stationary.

1 Claim, 12 Drawing Figures

FIG.4
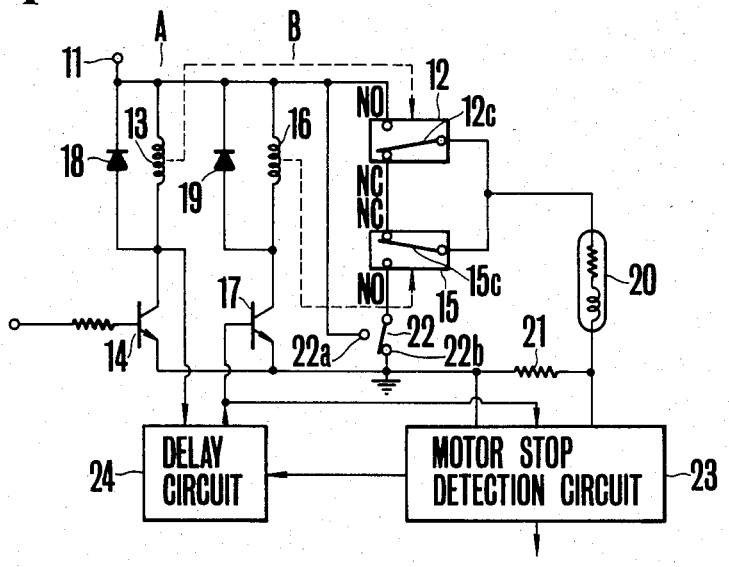
FIG.5a
FIG.5b
FIG.5c
FIG.5d
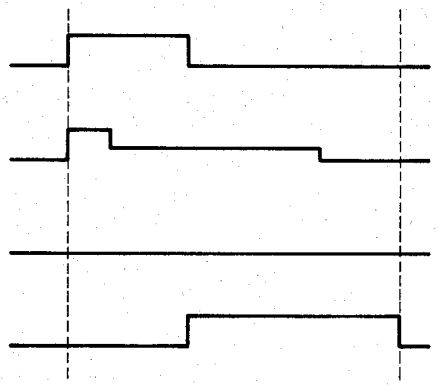
FIG.6a
FIG.6b
FIG.6c
FIG.6d
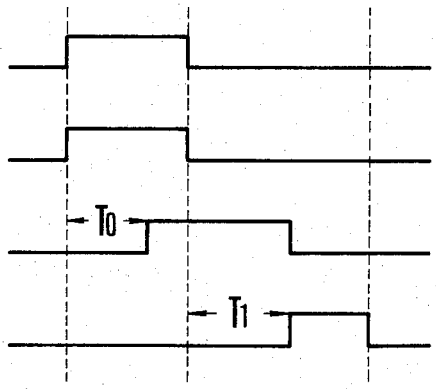

APPARATUS FOR PREVENTING ARC DISCHARGE OF TRANSFER SWITCH CIRCUIT FOR INDUCTIVE LOAD

This application is a continuation of application Ser. No. 21,132, filed Mar. 16, 1979, now abandoned.

BACKGROUND OF THE INVENTION

This invention relates to apparatus for preventing arc discharge of a transfer switch circut, especially used for switching an inductive load.

When opening an inductive load, for example, an electric motor, by a relay or contactor, an excessive arc discharge occurs across the contacts of the relay. In a prior art transfer switch circuit, as shown in FIG. 1, a source 3 is connected between opposing stationary contacts 1 and 2, and an electric motor 5 is conected to a movable contact 4 movable between the stationary contacts 1 and 2. When the movable contact 4 is transferred from the stationary contact 1 to the stationary contact 2 by a snap action, the eletromagnetic energy stored in the inductance L of the motor 5 creates electric discharge between contacts 1 and 4. Such discharge persists by the energy fed from the source 3 even after contact 4 engages stationary contact 2.

For this reason, it has been the practice to connect across contacts an arc preventing element, such as a resistor or a capacitor having a suitable rating for preventing melting or welding of the contacts.

However, in an environment where the temperature condition is severe as in a transfer switch circuit carried by a vehicle, the reliability of a conventional oil filled capacitor is low, and a mylar capacitor is difficult to construct to have a large capacity although its capacitance variation is relatively insensitive to temperature variation, so that these capacitors are not suitable for being used as an arc preventing element of a transfer switch circuit utilized for a large inductive load.

SUMMARY OF THE INVENTION

Accordingly, it is an object of this invention to provide an improved apparatus for preventing arc discharge of a transfer switch circuit for an inductive load that enables the transfer switch to operate stably and reliably over a long time.

According to this invention, there is provided arc discharge preventing apparatus for transfer switch circuit comprising transfer switch means including a pair of stationary contacts connected across a source of supply and a movable contact movable between the stationary contacts and connected to an inductive load, wherein means is provided for temporarily stopping the movable contact while it is being moved from one stationary contact to the other.

The last mentioned means comprises a rotary cam having a high point, a low point and an intermediate peripheral portion, and the operating lever of the movable contact is provided with a shoulder which rides on the periphery of the cam.

BRIEF DESCRIPTION OF THE DRAWINGS

In the accompanying drawings:

FIG. 4 is a connection diagram showing still another modification of the arc discharge preventing apparatus; and FIGS. 5*a* to 5*d* and 6*a* to 6*d* are timing charts useful to explain the operation of the embodiment shown in FIG. 4.

DESCRIPTION OF THE PREFERRED EMBODIMENTS

Figure 1:
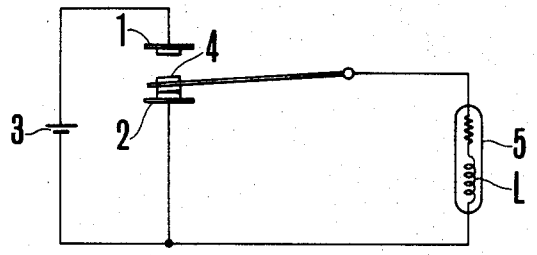
FIG.1 (PRIOR ART)
FIG. 1 illustrates one example of the prior art transfer switch circuit.
Figure 2:
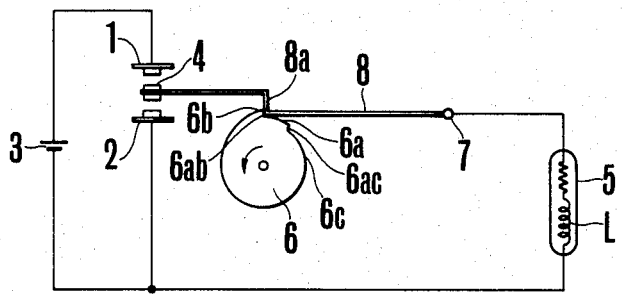
FIG. 2 shows a transfer switch circuit incorporated with an arc discharge preventing apparatus of this invention.

A preferred embodiment of the arc discharge preventing apparatus shown in FIG. 2 comprises spaced apart stationary contacts 1 and 2 which are connected to a source 3, and a movable contact 4 mounted on one end of a lever 8 with its other end rotatably supported by a pivot pin 7. An electric motor 5, for example, a wiper motor of a motor car is connected across the stationary contact 2 and the movable contact 4. A rotary cam 6 is disposed around the center of the lever 8 so as to rotate the lever 8 about the pivot pin 7 for transferring the movable contact 4 between the stationary contacts 1 and 2. The lever 8 is bent at its middle portion to form a step or shoulder 8*a*, and the cam 6 is rotated by a gear mechanism, not shown, in the counterclockwise direction and its periphery is provided with steps or shoulders 6*ab* and 6*ac*. The diameter of the cam decreases gradually from a high point 6*b* to a low point 6*c*. Accordingly, when the shoulder 8*a* of the lever 8 ridese on the high point 6*b*, the movable contact 4 is thrown to the stationary contact 1, whereas when the sehoulder 8*a* rides on a peripheral portion 6*a* between the high and low points, the movable contact 4 will not engage both the stationary contacts 1 and 2. When the shoulder 8*a* drops onto the low point 6*c* as the cam rotates, the movable contact 4 will come to engage the statioary contact 2. Since the length of the radial shoulder 8*a* of the lever 8 is selected to be longer than the shoulder 6*ab* at the high point 6*b*, the lever is precisely operated in accordance with the high point, intermediate portion and low point of the cam.

With the arc discharge preventing apparatus described above, it is possible to greatly decrease the arc discharge as compared with a case wherein the power feeding circuit to the motor 5 is interrupted by a switch not provided with any arc preventing device. More particularly, when the movable contact 4 is moved from the stationary contact 1 to the stationary contact 2 by the rotation of the cam 6, the movable contact 4 is temporarily stopped at an intermediate position by the intermediate portion 6*a* of the cam, and the energy stored in the inductance L of the motor 5 is completely dissipated at this intermediate position so that when the movable contact 4 engages the stationary contact 2, no arc exists. The result of experiment showed that where the rest time of the movable contact is made to be (0.025 to 0.09)$\times T_0$, good results were obtained, where $T_0$ represents the time for one reciprocution of the wiper. Thus, when $T_0=1.2$ sec, the rest time is from 0.03 to 0.1 sec. Actually, outside the preferable range of rest time, 0.03 to 0.1 sec., the rest time can be above 3 to 5 milliseconds which are required for discharging the electromagnetic energy stored in the motor.

Figure 3:
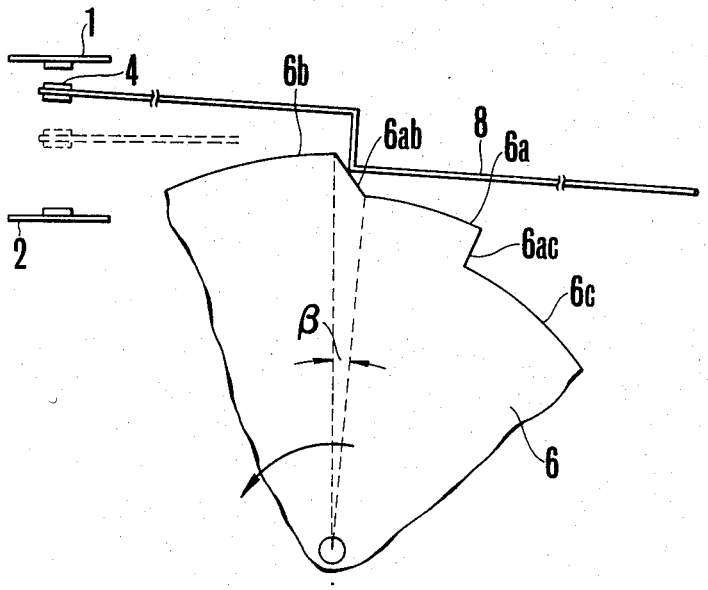
FIG. 3 shows a portion of a modified arc discharge preventing apparatus.

FIG. 3 shows a modification of FIG. 2. In the cam shown in FIG. 2, as the shoulder 6*ab* between the high point 6*b* and the intermediate portion 6*a* is sharp, the movable contact 4 moves instantly from the stationary contact 1 to the rest position, so that the movable contact 4 tends to vibrate between the stationary contacts 1 and 2, thus decreasing the arc discharge preventing capability. Furthermore, as the vibration due to vibrations or shocks of a motor car, for example, is applied to the switch arrangement, which vibration causes a longitudinal vibration of the lever 8 wherein the shoulder 6*ab* is pushed counterclockwise by the shoulder 8*a* of lever 8, the cam 6 is forced to rotate counterclockwise an angle corresponding to the backlash of a cam grear which is arranged close to the cam in the driving gear mechanism. Then the temporal rest time of the movable contact 4 decreases corresponding to the rotated angle, thereby decreasing the arc preventing effet.

The modification shown in FIG. 3 is proposed to solve this problem in which portions corresponding to those shown in FIG. 2 are designated by the same reference numerals. This modification is different from the embodiment shown in FIG. 2 in that the step or shoulder 6*ab* between the high point 6*b* and the intermediate portion 6*a* is inclined by subtending an angle corresponding to the backlash of the cam gear.

With this construction, the movable contact 4 moves gradually from the stationary contact 1 to the intemediate position whereby vibration or chattering of the movable contact 4 can be prevented when it comese into the temporal stoppage. Accordingly, the movable contact will not chatter while being prevented from coming into contact with the stationary contact 2, thus assuring the arc discharge preventing function.

In the event that the cam gear is rotated counterclockwise by an angle corresponding to its backlash by the vibration described above, the cam is forcibly rotated counterclockwise by a cam peripheral component of a force resulting from the lever biased toward the cam by its resiliency or a suitable biasing means (not shown) and exerting on the gentle shoulder 6*ab* between the high point 6*b* and the intermediate portion 6*a* by the angle corresponding to the bocklash, so that the interval during which the movable contact is temporarily stopped is made to correspond to the peripheral length of the intermediate portion 6*a*, thus preventing decrease in the arc preventing effect.

When the cam undergoes precession by an angle corresponding to the backlash of the cam gear, the load of the driving gear decreases so that the driving gear increases its speed to achieve instant cancellation of the backlash which is followed by the rotation of the cam. For this reason, the stay time of the movable contact 4 would not exceed an interval corresponding to the peripheral length of the intermediate portion 6*a*.

In this modification, although the length of the inclined portion 6*ab* correseponds to the backlash angle of the cam driving gear, this length may be increased or decreased slightly.

While in the foregoig embodiment, the movable contact is held stationary momentarily by mechanical means, the same object can also be accomplished by an electronic circuit as shown in FIG. 4.

As shown in FIG. 4, a first contact driving circuit A and a second contact driving circuit B are connected between a source terminal 11 and ground. The first contact driving circuit A comprises an energizing coil 13 adapted to operate a first transfer switch 12 and a switching transistor 14 connected in series with the coil 13, whereas the second contact driving circuit B comprises a series connection of an energizing coil 16 adapted to operate a second transfer switch 15 and a switching transistor 17. Reverse current preventing diodes 18 and 19 are connected in parallel respectively with energizing coils 13 and 16. The normally opened contact NO of the transfer switch 12 is connected to the source terminal 11 while a wiper driving motor 20 and a resistor 21 are connected in series between the movable contact 12*c* and ground. The movable contact 12*c* and the normally closed contact NC of the transfer switch 12 are respectively connected to the movable contact 15*c* and the normally closed contact NC of the transfer switch 15. A self-holding switch 22 for the wiper driving motor 20 is connected between the normally opened contact NO of the transfer switch 15 and ground. At the time of starting the wiper motor 20, the movable contact of the self-holding switch 22 is thrown to a stationary contact 22*a* to connect the normally opened contact NO of the transfer switch 15 to the source terminal 11 and when the wiper, not shown, rotated by the motor 20 is brought to a predetermined position, the transfer switch 22 is thrown to the other contact 22*b*.

A motor stop detection circuit 23 is connected across resistor 21. The motor stop detection circuit 23 detects the stop of the wiper in response to an excessive current which flows through the resistor 21 when the wiper is stopped by external force. When the circuit 23 detects the stop of the wiper, it operates such an alarm device as lamp or buzzer, not shown. In order to prevent the motor stop detection circuit 23 from detecting an excessive current which flows when the motor starts, it is provided with delay means such that the detection circuit becomes operative a predetermined time after starting the motor. Also a delay circuit 24 is connected to the output of the motor stop detection circuit 23. In response to the output of the detection circuit 23, the delay circuit 24 produces a signal which turns on the switching transistor 17 of the second contact driving circuit B a predetermined time after turning off the switching transistor 14 of the first contact driving circuit A. In the absence of the output of the motor stop detection circuit 23, the delay circuit 24 produces an output which turns on the switching transistor 17 at the same time or a little after the switching transistor 14 is turned off.

The arc preventing circuit for the wiper driving circuit described above operates as follows.

The normal operation of the motor 20 is shown in FIGS. 5*a* to 5*d* which show a timing chart of one cycle. When a wiping start signal as shown in FIG. 5*a* is applied to the base electrode of the switching transistor 14, it is turned on. Then current flows through the energizing coil 13 to throw the movable contact 12*c* of transfer switch 12 to the normally opened contact NO. Then, the motor 20 is started to drive the wiper and the self-holding switch 22 is thrown to contact 22*a* to connect the normally opened contact NO of the transfer switch 15 to the source terminal 11. At the time of starting the motor 20, a large rush curent flows but this current decreases soon to a normal value as shown in FIG. 5*b*. Although such current flows through resistor 21, due to the delay means described above, the motor stop detection circuit 23 does not respond to the starting rush current as shown by FIG. 5*c*. When the wiping start signal decreases to zero as shown in FIG. 5*a*, or a little time later, the delay circuit 24 produces a signal which turns on the switchig transistor 17 as shown in FIG. 5*d*. At the same time or a little time later, the movable contact 12*c* of the transfer switch 12 engages its normally closed contact NC and then the operating coil 16 throws the movable contact 15*c* of the transfer switch 15 to its normally opened contact NO. Thereafter, the wiper motor 20 is driven from the source terminal 11 through the self-holding switch 22 and the transfer switch 15, and continues to rotate at the previous speed with the normal operating current freed from any starting rush current. When the wiper reaches a predetermined stop position, the self-holding switch 22 is thrown to the ground contact 22*b* to stop the motor.

The operation of the motor when the wiper is locked by an external force will now be described with reference to FIGS. 6*a* to 6*d* also illustrative of a timing chart showing one cycle of the sequence. When a wiping start signal shown in FIG. 6*a* is applied to the base electrode of the switching transistor 14, the transfer switch 12 is operated to drive the wiper motor 20. Assume now that the wiper is locked by an external force, an excessive current as shown in FIG. 6*b* would flow through the motor 20 while the wiping start signal is being applied. Since this excessive current also flows through the resistor 21 connected in series with the motor, the motor stop detection circuit 23 detects the excessive current a defiite time ($T_0$) after starting the motor as shown in FIG. 6*c*. Accordingly, the motor stop detection circuit 23 sends an alarm signal to a lamp or a buzzer and an output signal to the delay circuit 24. In response to this output, the delay circuit 24 produces a signal which turns on switching transistor 17 a predetermined time ($T_1$) after turning off the switching transistor 14. At this time, the transfer switch 12 is thrown to the normally closed contact NC whereas the transfer switch 15 is thrown to the normally opened contact NO. Concurrently therewith, the motor stop detection circuit 23 terminates the alarm signal and the output to the delay circuit 24.

With the arc discharge preventing circuit shown in FIG. 4, when the wiper is stopped by snow laid on the front glass of the motor car, the wiper driving motor 20 is overloaded. To stop the motor, the movable contact 12*c* of the transfer switch 12 is transferred from the normally opened contact NO to the normally closed contact NC which is connected to the movable contacts 12*c* and 15*c* of respective transfer switches 12 and 15 which are floating with respect to ground. Accordingly, after the movable contact 12*c* has engaged the normally closed contact NC, the arc caused by the discharge of the electromagnetic energy stored in the motor would not be affected by the current supplied from the source. The movable contact 15*c* of the transfer switch 15 is thrown to the normally opened contact NO a predetermined time ($T_1$) after engagement of the movable contact 12*c* with the normally closed contact NC of the transfer switch 12. This tends to permit the continuous operation of the motor 20 through the self-holding switch 22. At this tine, however, since the wiper is being originally locked, the self-holding circuit 22 is thrown to the grounded contact 22*b*. For this reason, the movable contact 15*c* of the transfer switch 15 engages the not grounded normally closed contact NC during the time T1 whereby the arc between the movable contact 12*c* and the normally opened contact NO of the transfer switch 12 would be extinguished during this time $T_1$.

As described above, according to this invention, since it is possible to effectively prevent arc discharge without using a capacitor which is liable to be influenced by temperature variation, the arc preventing device operates reliably over a long time. The invention is advantageous for use in a switch circuit of a motor for operating an intermittently operated wiper of a motor car.

What is claimed is:

1. In an arc discharge preventing apparatus for a transfer switch circuit comprising transfer switch means including first and second stationary contacts connected across a source of supply, a movable contact means coupled to an inductive load, and means for transferring said movable contact means between first and second contact positions in which said movable contact engages said first and second stationary contacts, respectively, the improvement wherein said transferring means includes camming means engaged with said movable contact means for controlling the position thereof, and means for rotating said camming means, said rotating means having a backlash angle, said camming means including a first camming surface for maintaining said movable contact means in said first contact position, a second camming surface for maintaining said movable contact means in said second contact position, a third camming surface for maintaining said movable contact in an intermediate position between said first and second contact positions, and a fourth camming surface providing a transitional slope between the trailing edge of said first camming surface and the leading edge of said third camming surface, said fourth camming surface subtending an angle substantially equal to said backlash angle.

* * * * *